US006010053A

United States Patent [19]

Werfeli

[11] Patent Number: 6,010,053

[45] Date of Patent: Jan. 4, 2000

[54] DEVICE FOR FITTING BAR COMPONENTS IN A FRAME

[75] Inventor: Benjamin Werfeli, Däniken, Switzerland

[73] Assignee: Maschinenbau Beni Werfeli, Däniken, Switzerland

[21] Appl. No.: 09/043,227

[22] PCT Filed: Sep. 11, 1996

[86] PCT No.: PCT/CH96/00312

§ 371 Date: Mar. 11, 1998

§ 102(e) Date: Mar. 11, 1998

[87] PCT Pub. No.: WO97/10406

PCT Pub. Date: Mar. 20, 1997

[30] Foreign Application Priority Data

Sep. 11, 1995 [CH] Switzerland ..... 2571/95

[51] Int. Cl.[7] ..... E06B 3/673

[52] U.S. Cl. ..... 227/99; 227/105; 227/148; 227/152; 227/154; 269/320

[58] Field of Search ..... 227/99, 100, 101, 227/104, 105, 152, 148, 153, 154; 269/320

[56] References Cited

U.S. PATENT DOCUMENTS

| | | | |
|---|---|---|---|
| 3,559,863 | 2/1971 | Sack | 227/152 |
| 4,133,097 | 1/1979 | Slade | 227/101 |
| 4,453,705 | 6/1984 | McDonald | 227/152 |
| 4,479,600 | 10/1984 | Albright | 227/148 |
| 4,492,016 | 1/1985 | Smets et al. | 227/105 |
| 4,495,023 | 1/1985 | Lisec | 269/320 |
| 4,620,658 | 11/1986 | Martin | 227/154 |
| 5,605,270 | 2/1997 | Dunn | 227/152 |

*Primary Examiner*—Scott A. Smith

[57] ABSTRACT

A device for assembling sash elements (12) in a frame (11) disposes over instruments (8) for clamping the frame (11). An angle template (7) is provided for inserting the sash element (12) which is freely movable on a predefined plane in relation to the clamped frame (11). The sash element can be held fast and be pushed into the desired assembly position at a set angle on the angle template.

28 Claims, 3 Drawing Sheets

DEVICE FOR FITTING BAR COMPONENTS IN A FRAME

This application is the national phase under 35 U.S.C. §371 of prior PCT International Application No. PCT/CH96/00312, which has an International filing date of Sep. 11, 1996, which designated the United States of America, the entire contents of which are hereby incorporated by reference.

FIELD OF THE INVENTION

The invention concerns a device for assembling a sash element in a frame with instruments for clamping the frame.

DESCRIPTION OF RELATED ART

In manufacturing insulation windows with viewing sashes mounted in the pane interior, the sash elements are is first assembled in a range spacer frame. Then the frame so prepared is glued on both sides with glass panes. The range spacer frame is, for example, a hollow aluminum section. Owing to its light construction, it is flexible to a certain degree. The sash elements, for example, consist of crossing wooden slats. The connection at the crossing point likewise permits minor angle deviations. In assembling the window, care must be taken that the sash element, for example, a sash cross, is mounted exactly at right angles to itself and parallel to the sides with respect to the frame.

Positioning the frame on a table with line grid drawn in and inserting the sash component adjusted in relation to the grid lines is known. The disadvantage of this method is that the angle exactitude of the finished mounted sash element in the frame largely depends on the capability of the worker and his condition at the moment.

Predrilling the frame at the necessary positions and then inserting the sash elements with an appropriate peg is also known. This requires not only a high drilling precision and a separate processing step for the sash elements (for production of the pegs), but the orthogonality is still not guaranteed.

SUMMARY OF THE PRESENT INVENTION

The object of the invention is to provide a device, which makes possible a set angle and rapid assembly of sash elements in the frame. Furthermore, the device should be suitable for assembling frames of varying size without conversion operations.

The present invention is distinguished in that a freely movable angle template (i.e., movable in at least two different directions while retaining the angle setting) is provided with instruments for holding the sash element in a desired angle setting so that the sash element is pushed at the adjusted angle into the desired assembly position and can be joined with the frame.

The angle template gives the sash element, namely a sash cross, the desired angle setting (for example, a 90° setting). At the same time, the sash element does not yet need to be in the desired assembly position. The sash element can then, for example, be freely moved on a predefined plane while maintaining its angle setting (in relation to the clamped frame). That means that the sash element can be brought to the frame and fixed there.

It is essential for the present invention that first and second instruments for clamping the sash element and the frame be provided, whereby at least one of the two instruments includes an angle template for holding the sash element or frame in a desired angle setting, and that at least one of the two instruments is freely movable in at least two different directions while retaining the angle setting relative to the other, so that the sash element and frame can be pressed into a desired assembly position at the set angle and joined.

In accordance with an especially preferred embodiment, the angle template is guided on two crossing parallel travelling arms. Each parallel travelling arm guarantees parallel guidance in one direction of a predefined plane. It is also possible to work with only one parallel travelling arm on which the angle template can be moved in one direction. The guidance can instead also take place with a hinged bracket in connection with which the angle setting of the angle template is maintained independently of the arm setting, for example by cable lines (similar to a drawing device).

The parallel travelling arms thus ensure that the angle template can be moved while maintaining the angle setting relative to the clamped frame. The angle template is guided, for example, by two low friction linear guidance systems (roller bearings or the like) on the two parallel travelling arms.

To ensure parallel guidance, the parallel travelling arms can be guided by two trucks mechanically coupled to each other (preferably arranged end to end) on rails. The trucks can be secured advantageously in any desired position. Pneumatically or electromagnetically activated brakes, for example, can be provided for this purpose. In order to facilitate the assembly of individual sashes, a motion pickup can furthermore be installed on the trucks to make positioning according to preset dimensions possible. The position of the motion pickup is conveyed, for example, digitally, to the indicator.

In accordance with a further preferred embodiment, at least one parallel travelling arm is provided with a clamping device which is arranged in alignment with the angle template, and can serve to fix the end of the sash element. A sash cross is thus not only picked up at the adjusted angle in the center, but also on the end to be assembled. This clamping device can also be activated pneumatically or electromagnetically, for example.

The parallel travelling arms can also have available a device for fastening the sash element onto the frame. Thus, a nail gun, for example, can be present aligned with the parallel travelling arm or the clamped lash element, which can be positioned and activated on the clamped frame from without. This has the advantage that the fastening nail is always shot in at the right place. There are no target or shooting mistakes.

The angle template has, for example, a 90° set angle stop for a lash cross. A clamping device which can be activated pneumatically or electromagnetically, for example, fixes the sash cross on the expected angle stop. An especially simple clamping device is distinguished by a sliding clamp which can be moved bisecting the 90° set angle stop. This thus engages on the side of the sash cross which lies diametrically opposite on the adjusted angle stop. In a further advantage, the sliding clamp has a head which can be rotated about an axis perpendicular to the adjusted angle stop. In this way, it can be positioned flexibly on the cross of the sash element. This solution is advantageous specifically when sash elements and crosses of varying thickness are to be correctly clamped with cross arms of various thicknesses on the first stroke.

According to a further aspect of the invention, the device for assembling a sash part in a frame can be outfitted with a first means for clamping the sash element and a second means for clamping the frame, whereby the first and/or second means includes the angle template for holding fast the sash element or frame in a desired angle setting and whereby the first and/or second means can be freely moved in at least two different directions while maintaining the setting relative to the second or first means so that sash element and frame can be pushed into a desired assembly position with each other and joined.

The device of the invention can also be used for assembly of sash parts with several cross points. Two or more angle templates can be guided by providing at least two parallel travelling arms guided parallel to each other and at least one guided at right angles to the first named, and by conveying an angle template in each crossing point of the parallel travelling arms in each case. With three parallel traveling arms, two angle templates are possible, with four parallel travelling arms, four angle templates are possible.

If several angle templates are necessary, then the solution with the parallel travelling arms is superior to that with the bracketed hinge (simpler construction, no danger of collision).

Further advantageous embodiments and feature combinations emerge from the detailed description and the totality of the patent claims.

SHORT DESCRIPTION OF THE DRAWINGS

The drawings used for explanation of the embodiments show:

FIG. 1 A schematic representation of the assembly device of the invention in top view;

FIG. 2 A schematic perspective representation of an angle template guided on parallel travelling arms;

FIG. 3 A schematic representation of an end fixation in top view with a nail gun;

FIG. 4 A schematic elevation of a coupled truck with mechanical coupling;

FIG. 5 A schematic representation of a hinged bracket with cable lines for maintaining the angle setting of the angle template (alternative to parallel travelling arm guidance in accordance with FIG. 2).

In the drawings, like parts are basically provided with like designations.

DETAILED DESCRIPTION OF A PREFERRED EMBODIMENT

Figure 1:
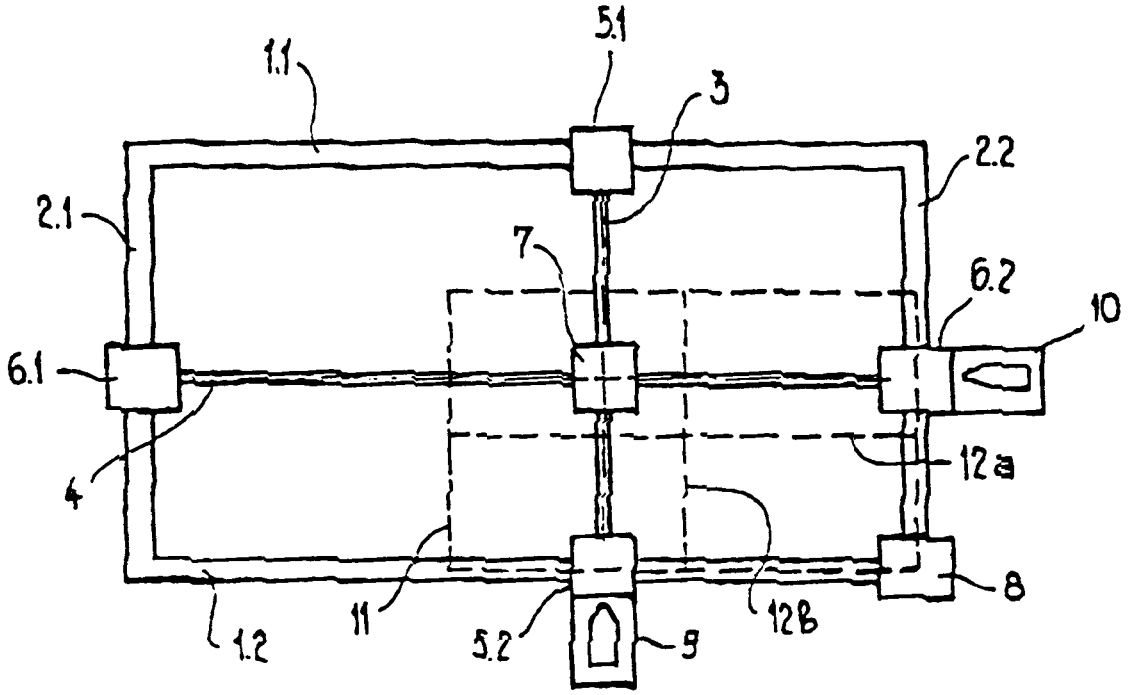

The assembly device of the invention has available in accordance with FIG. 1 a rigid, rectangular frame construction which is formed by four rails 1.1, 1.2, 2.1, 2.2. They serve in pairs for guiding, for example, one parallel travelling arm 3, 4 each. The parallel travelling arm 3 is outfitted with one truck 5.1, 5.2 each at its ends which run on the rails 1.1 or 1.2. Correspondingly, the parallel travelling arm 4 has two trucks 6.1, 6.2 which run on rails 2.1, 2.2 parallel to each other. The parallel travelling arms 3, 4 stand at right angles to each other and can correspondingly only move in two travel directions which are at right angles to each other.

In the present example, the rails 1.1, 1.2 are longer than the rails 2.1, 2.2. This is because the range spacer frames for insulation vitrages (which represent a preferred application) are as a rule rectangular. Basically, it does not, however, depend on the form and size of frame construction. It should also be noted that the rectangular character is not necessary, but rather happens to result from the application selected here.

The angle template 7 is situated at the crossing point of the two parallel travelling arms 3, 4. It is mounted on the parallel travelling arms 3, 4 with low friction. It becomes clear from the preceding discussions that the angle template 7 is freely movable on a predefined plane (within the frame construction defined by the rails 1.1, 1.2, 2.1, 2.2) while maintaining the angle setting (relative to the aforementioned frame of the device).

At the point of intersection of the rails 1.2 and 2.2, an angle holder 8 is rigidly mounted. It serves to clamp a range spacer frame 11 (hereinafter called frame 11 for short) in which a sash cross is to be mounted.

Before going into further details of the assembly device, handling will now be briefly explained.

In the first step, the frame 11, which basically can have any desired dimensions, is positioned on the device and fixed with the angle holder 8 (cf FIG. 1). Catches are provided on trucks 5.2, 6.2 which are aligned with the angle holder 8 and ensure that the corresponding sides of the frame 11 stand exactly at right angles in relation to each other. Orthogonality is thus guaranteed regardless of where the parallel travelling arms 3, 4 are.

In the next step, the sash cross 12*a*, 12*b* is positioned in the angle template 7. The clamping device provided on the angle template 7 is activated and clamps the sash cross 12*a*, 12*b* at exactly right angles. The sash cross (which, for example, consists of two crossing wooden slats 12*a*, 12*b*, as mentioned above) is not in itself absolutely rigid, but is slightly variable with respect to an angle between slats thereof. This slightly variable is used during clamping to attain the desired angle setting.

Now the sash cross can be slid from the (random) position A into the assembly position. For this, it is sufficient to grasp the angle template 7 and move it such that the ends of the arms of the sash cross lie on the appropriate interior sides of the frame 11. While moving, the parallel travelling arms 3, 4 ensure that the angle position of the sash cross 12 is maintained with respect to the clamped frame 11.

When the ends of the sash cross lie filly on both sides of the frame 11 which are above rails 1.2 and 2.2, the corresponding ends of the sash cross 12 can be clamped fast with clamping devices which are provided on the trucks 5.2, 6.2. The angle template 7 holding fast the sash cross 12 is therewith automatically restrained in a similar fashion. As an alternative, or in addition, restraining devices on the trucks 5.1, 5.2, 6.1, 6.2 can be provided in order to fix the parallel travelling arms in this way.

Now the two clamped ends of the sash cross 12 can be joined with the adjacent sides of the frame 11. In the present example, this takes place through shooting in a nail with the help of a nail gun 9, 10. Each nail gun 9, 10 is arranged in aligned position with the clamped sash cross 12 or with the corresponding parallel travelling arm 3 or 4. It is movable in any given case in the direction of the appropriate parallel travelling arm 3, 4 to be positioned on the frame 11. From what has been said, it emerges that the nail is always shot in centered in relation to the corresponding arm of the sash cross 12.

Next all catches are released so that the frame 11 can be removed with the partially assembled sash cross 12 and reinserted rotated 180°. The fastening of the two remaining free ends of the sash cross basically runs according to the schema already discussed.

Figure 2:
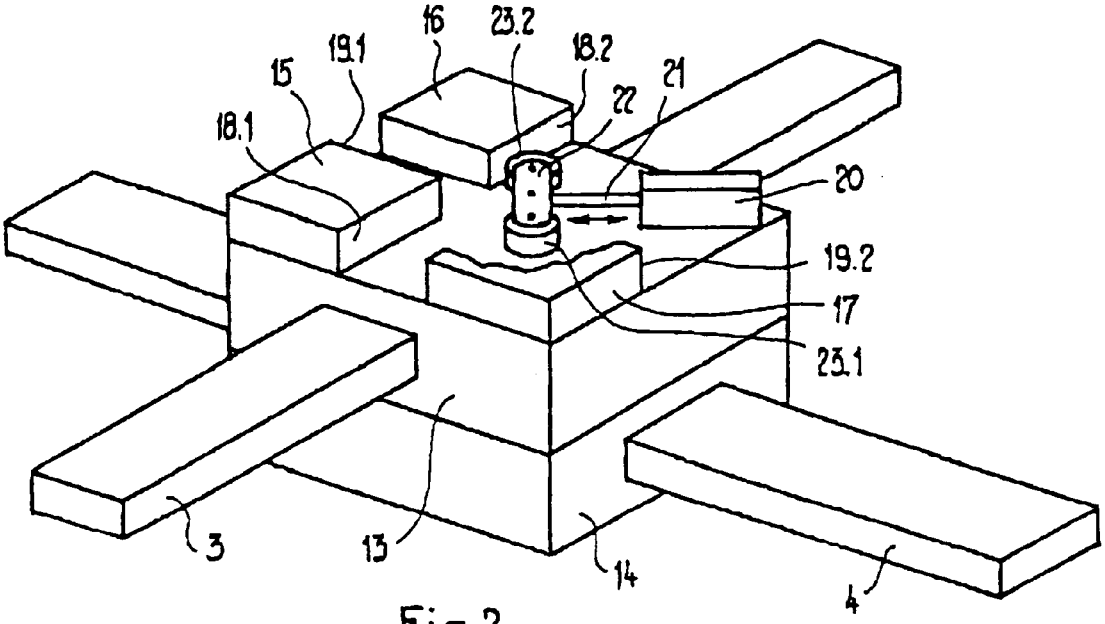

FIG. 2 shows a representation of a preferred embodiment of an angle template 7. A first roller guide system 13 (for guidance linear) runs on the parallel travelling arm 3 (shown in section in FIG. 2). It is rigidly connected with a second roller guide system 14, whereby the latter rolls on the parallel travelling arm 4 (likewise shown in section in FIG. 2). The travel directions of the two roller guide systems 13, 14 stand perpendicular to each other.

In FIG. 2, it can be recognized that the parallel travelling arms 3 and 4 are likewise situated on different planes.

On the upper roller guide system 13 in the present example, a device for clamping a sash cross is located. This has, for example, blocks 15, 16, 17 arranged in an l-shape at a distance from one another. They are, for example, right parallelepiped-shaped, have a square area and are fastened in the corners of the square roller guide system 13. The two blocks 15, 16 form aligning stop faces 18.1, 18.2. Stop surfaces 19.1, 19.2 are formed at exact right angles to the two stop surfaces 18.1, 18.2 mentioned through the blocks 15 and 17 (which are covered in the representation according to FIG. 2).

The distances between the blocks 15, 16, and 17 are so large that various thicknesses of sash crosses can be inserted. A pneumatic cylinder 20 with a piston rod 21 and a head 22 is provided for fixation. The piston rod 21 moves on an angle bisector with relation to the stop surfaces 18.1, 19.1. The head 22 is basically formed by a carrier which is flexibly joined with the piston rod 21 and has two rollers 23.1 and 23.2 on both its ends. The head 22 can be rotated around an axis perpendicular to the clamping plane of the sash cross (or around the movement directions of the angle template). Upon clamping the sash cross, the head 22 can thus be flexibly adapted to the appropriate cross neck. The rollers 23.1, 23.2 prevent the sash cross from being damaged during clamping.

The pneumatic cylinder 20 is situated in the corner of the roller guide system 13 which lies diametrically opposite that occupied by the block 15.

Figure 3:
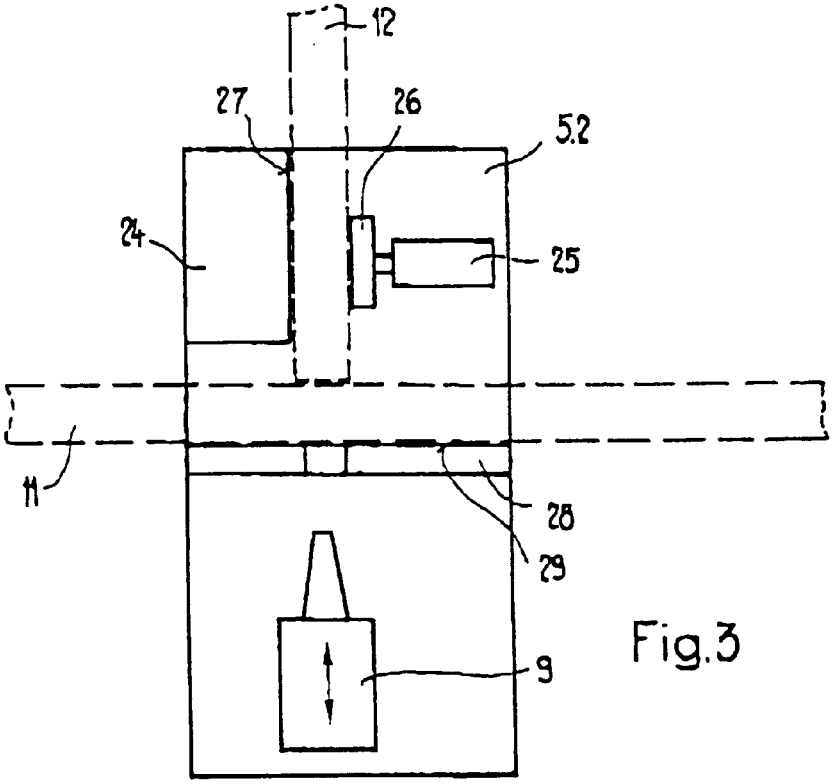

An embodiment for the truck 5.2 is represented in detail in FIG. 3. The frame 11 and the end of the emplaced sash cross 12 are drawn in dotted lines. A block 24 for adjusting and fixing is mounted on the truck 5.2 and has a surface which lies on the same plane as that of the roller guide system 13. It has a stop surface 27 which is aligned with the stop surface 18.1 of the angle template (cf. FIG. 1). The corresponding arm of the sash cross 12 is thus adjusted with respect to angle in the crossing point (through stop surface 18.1) as well as at the end (through the stop surface 27). A pneumatic cylinder 25 is provided opposite block 24 which presses the arm of the sash cross 12 with the clamping head 26 against the stop surface 27.

The truck 5.2 also has a block 28 with a stop surface 29 for the frame 11. The stop surface 29 is constructed aligned with a corresponding stop surface of the angle holder 8 (FIG. 1). The frame 11 is also therewith positioned in its direction. Sash cross 12 and frame 11 can thus be joined to each other exactly at right angles.

A nail gun 9 is provided on the exterior or back side of the block 28 and can be moved toward or away from the frame 11. It is positioned on the frame 11 to shoot the nail in, whereby a guide for the nail gun 9 (not represented) necessarily ensures that the nail is shot in centered with respect to the arm of the sash cross 12.

The truck 6.2 is basically outfitted in the same way as the truck 5.2 just described.

Figure 4:
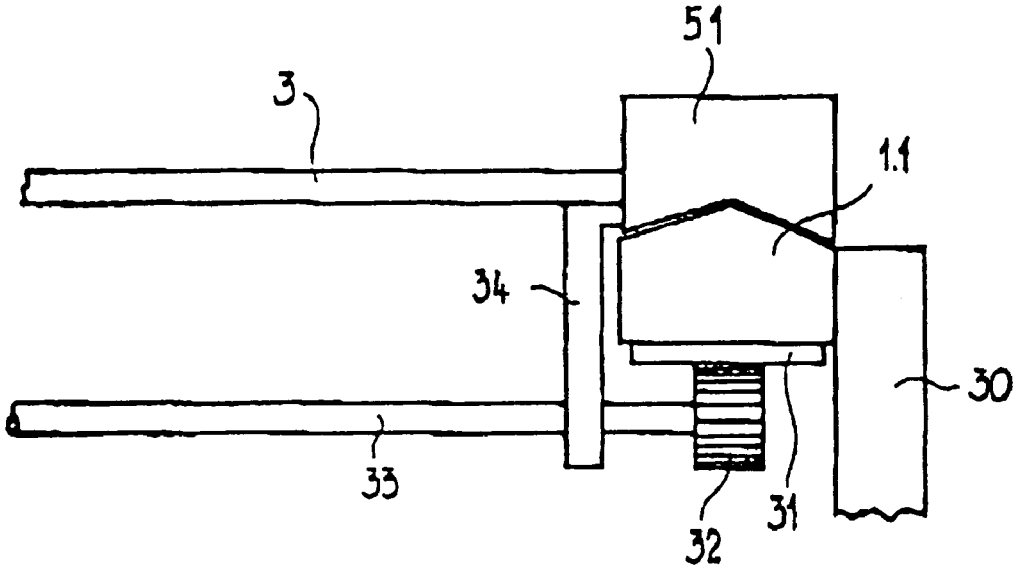

FIG. 4 schematically depicts a preferred embodiment to assuring the synchronous running of both trucks 5.1, 5.2 of the parallel travelling arm 3. The rail 1.1 is for example held to the side of a carrier 30. A rack 31 is provided on their underside. A carrier 34 projects downward on the truck 5.1. It has a bearing for a shaft 33. A bevel gear 32 is arranged on the end of the shaft 33 and is engaged with the rack 31. The truck 5.2 is symmetrically constructed, as described above. The shaft 33 (which extends in the same direction as the parallel travelling arm 3) thus represents a mechanical connection between the two trucks 5.1, 5.2. Any movement of one of the trucks is necessarily transmitted to the other truck over the bevel gear 32 and shaft 33.

It should be noted that it becomes possible, through the distance between parallel travelling arm 3 and shaft 33, to pass the parallel travelling arms standing perpendicular in relation to each other through each other by arranging them at various heights without having to select different constructions.

The invention is, of course, not restricted to the embodiments represented. It is thus, for example, not required that the angle template must run on two parallel travelling arms. Of course, in this case only the one end of the sash cross can be held at the correct angle (namely the one which stands in the same direction as the parallel travelling arm).

Nor is it necessary for the parallel travelling arms to stand perpendicular to each other. It suffices if they cannot change their own angle setting in relation to the clamped frame.

Figure 5:
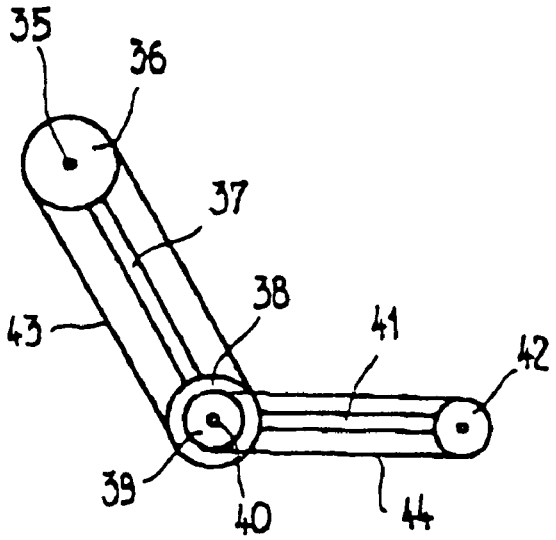

FIG. 5 illustrates a hinged bracket usable instead of parallel travelling arms with the fixed angle setting of the end element. The construction is inherently known and is for this reason only being briefly described. A circular disk 36 is centrally fixed on a fixed point 35. An arm 37 is moreover rotatable around the fixed point 35. At the opposite end of the arm 37, two concentric circular disks 38 and 39 are rotatably mounted. The two circular disks 38, 39 are rigidly connected with each other and can only rotate together around the axis of rotation 40. A further rotating arm 41 goes out from the axis of rotation 40 and bears a circular disk 42 on the opposite lying end. Circular disks 38, 39 as well as circular disk 42 swivel on arm 41.

The circular disks 36 and 38 have the same diameter and are connected by a cable line 43. This is passed on the periphery of the circular disks 36 and 38 and holds the circular disks 36, 38 at a fixed angle in relation to each other. As intended, the circular disks 39 and 42 are connected by a cable line 44. As a consequence, the circular disks 36 and 42 always have the same angle setting independently of the position of arms 37,41. If the circular disk 36 is fixed on the frame construction of the device, then the angle template can be freely moved on a plane while maintaining the angle setting. The hinged bracket in accordance with FIG. 5 is thus basically equivalent to guides by parallel travelling arms.

The size of the frame construction formed by the rails 1.1, 1.2, 2.1, 2.2 is in no way restrictive for the size of the range spacer frame to be processed. The latter can be larger or smaller than the frame construction.

The above-described arrangement can be reversed, in the sense that a sash element is held fast in place and the range spacer frame is shifted (while maintaining the angle setting), is also contemplated according to the present invention.

The details shown on the basis of FIG. 2 to 4 can be replaced by other constructions in their function. The mechanical coupling of shaft and bevel gear can be omitted if, for example, two guidance systems are provided at each end of a parallel travelling arm which can guarantee the requisite angle stability of the parallel travelling arm.

In summary, it should be stated that a simply and easily handled device with respect to construction is created through the invention which is flexibly adaptable to the dimensions of the object to be assembled, and therefore has especially great advantages in production runs with small lot numbers.

I claim:

1. A device for assembling a sash cross element in a frame, comprising:

a clamping device for clamping a frame; and an angle template constructed and arranged to orient respective members of a sash cross element in a fixed angular relationship to each other, wherein said angle template and said clamping device are movable relative to each other such that the sash cross element can be positioned relative to the frame.

2. The device according to claim 1, wherein said angle template and said clamping device are movable relative to each other in at least two different directions.

3. The device according to claim 2, wherein said angle template and said clamping device are movable relative to each other in at least two orthogonal directions.

4. The device according to claim 1, further comprising:

a guide frame including a pair of substantially parallel first guide rails and a pair of substantially parallel second guide rails, wherein said first guide rails are substantially perpendicular to said second guide rails;

a third guide rail extending between and movably mounted on said pair of first guide rails;

a fourth guide rail extending between and movable mounted on said second pair of guide rails;

wherein said angle template is located at an intersection of said third and fourth guide rails.

5. The device according to claim 4, wherein said third guide rail is movably mounted on said pair of first guide rails by a pair of first friction reducing assemblies provided at each end of said third guide rail.

6. The device according to claim 5, wherein said first friction reducing assemblies are constructed and arranged to be selectively lockable in position.

7. The device according to claim 5, wherein said first friction reducing assemblies are coupled so as to synchronize their movement along said pair of first guide rails.

8. The device according to claim 4, wherein said fourth guide rail is movably mounted on said pair of second guide rails by a pair of second friction reducing assemblies provided at each end of said fourth guide rail.

9. The device according to claim 5, wherein at least one said first friction reducing assembly is provided with a fastener driving device constructed and arranged to drive a fastener for fastening the frame and a distal end of the sash cross element.

10. The device according to claim 9, wherein said fastener driving device is a nail gun.

11. The device according to claim 8, wherein at least one said second friction reducing assembly is provided with a fastener driving device constructed and arranged to drive a fastener for fastening the frame and a distal end of the sash cross element.

12. The device according to claim 11, wherein said fastener driving device is a nail gun.

13. The device according to claim 8, wherein said second friction reducing assemblies are constructed and arranged to be selectively lockable in position.

14. The device according to claim 8, wherein said second friction reducing assemblies are coupled so as to synchronize their movement along said pair of second guide rails.

15. The device according to claim 4, wherein said third guide rail is movably mounted on said pair of first guide rails by a pair of first friction reducing assemblies provided at each end of said third guide rail, and said fourth guide rail is movably mounted on said pair of second guide rails by a pair of second friction reducing assemblies provided at each end of said fourth guide rail.

16. The device according to claim 15, wherein at least one said first friction reducing assembly is provided with a fastener driving device constructed and arranged to drive a fastener for fastening the frame and a first distal end of the sash cross element, and least one said second friction reducing assembly is provided with a fastener driving device constructed and arranged to drive a fastener for fastening the frame and a second distal end of the sash cross element.

17. The device according to claim 16, wherein at least one of said fastener driving devices is a nail guns.

18. The device according to claim 15, wherein said first and second friction reducing assemblies are constructed and arranged to be selectively lockable in position.

19. The device according to claim 15, wherein said first and second friction reducing assemblies are coupled so as to synchronize their movement along said pair of first guide rails and said pair of second guide rails, respectively.

20. The device according to claim 1, wherein said clamping device is positionally fixed and said angle template is movably provided.

21. The device according to claim 1, wherein said clamping device is movably provided and said angle template is positionally fixed.

22. The device according to claim 1, wherein said clamping device and said angle template is movably provided.

23. The device according to claim 1, wherein said angle template comprises:

a substrate;

block members arranged on said substrate to define a cross groove for receiving t he respective members of the sash cross element; and a urging device for urging the respective members of the sash cross element against said block members.

24. The device according to claim 23, wherein said block members define first and second orientation surfaces against which the respective members of the sash cross element are urged by said urging device.

25. The device according to claim 24, wherein said urging device is a piston-actuated clamp.

26. The device according to claim 1, wherein said angle template is constructed and arranged to orient the respective members of the sash cross element in a perpendicular relationship to each other.

27. The device according to claim 1, wherein said angle template is movable relative to said clamping device in a plane.

28. The device according to claim 4, wherein said angle template is movable relative to both said third and fourth guide rails.

* * * * *